United States Patent [19]

Alchermes

[11] 4,377,041

[45] Mar. 22, 1983

[54] ATHLETIC SHOE SOLE

[76] Inventor: Stephen L. Alchermes, 47 Southfield Rd., Glen Cove, N.Y. 11542

[21] Appl. No.: 163,051

[22] Filed: Jun. 26, 1980

[51] Int. Cl.[3] ..... A43B 13/12; A43B 13/14

[52] U.S. Cl. ..... 36/30 R; 36/31

[58] Field of Search ..... 36/30 R, 30 A, 31, 32 R, 36/103, 44

[56] References Cited

U.S. PATENT DOCUMENTS

| | | | |
|---|---|---|---|
| 981,154 | 1/1911 | Austin | 36/44 X |
| 3,824,716 | 7/1974 | Di Paolo | 36/32 R |
| 4,128,950 | 12/1978 | Bowerman et al. | 36/30 R |
| 4,309,832 | 1/1982 | Hunt | 36/31 |
| 4,316,332 | 2/1982 | Giese et al. | 36/30 R |

FOREIGN PATENT DOCUMENTS

| | | | |
|---|---|---|---|
| 537883 | 11/1931 | Fed. Rep. of Germany | 36/30 A |
| 2379994 | 9/1978 | France | 36/31 |
| 2452260 | 10/1980 | France | 36/30 R |

*Primary Examiner*—James Kee Chi

[57] ABSTRACT

This invention relates to an improved design associated with the fabrication and construction of an athletic shoe sole capable of minimizing stress and strain to the functioning portions of the human body associated with any athletic endeavor that utilizes an individual's lower extremities to participate in same. In accordance with the invention, there is created an athletic shoe sole that permits the mirroring as well as the complementing of the natural bend of the human foot at the metatarso-phalangeal joints in that the composition and construction of said athletic shoe sole coincident with its location at said metatarso-phalangeal joints varies from the overall composition of said athletic shoe sole so as to evidence compression and expansion characteristics different from that of the overall characteristics of the composition of material utilized in fabricating said athletic shoe sole thereby achieving the overall advantages of the invention.

4 Claims, 4 Drawing Figures

ATHLETIC SHOE SOLE

BACKGROUND AND OBJECTS OF THE INVENTION

The present invention relates generally to a new and improved design associated with the fabrication and construction of an athletic shoe sole capable of minimizing stress and strain to the functioning portions of the human body associated with any athletic endeavor that utilizes an individual's lower extremities to participate in same.

Prior to the present invention, various athletic shoe sole designs were known, but none of same lended themselves to the advantages and overall efficiencies achieveable in conjunction with the present invention.

It is in the context of the above that one of the primary objectives of the present invention is to create a new and improved design associated with the fabrication and construction of an athletic shoe sole capable of minimizing stress and strain to the functioning portions of the human body associated with any athletic endeavor that utilizes an individual's lower extremities to participate in same.

It is another object of this invention to create a new and improved design associated with the fabrication and construction of an athletic shoe sole wherein the composition of said sole coincident with its positioning adjacent to the metatarso-phalangeal joints of the wearer thereof is of a composition and construction such that its characteristics as to compression and expansion vary from that associated with the overall composition of said athletic shoe sole.

It is another object of this invention to create a new and improved design associated with the fabrication and construction of an athletic shoe sole wherein there is prevented the creating of additional stress and strain upon the lower extremities of the wearer of same due to adverse resistence caused by adverse compression or expansion characteristics of said sole at the metatarso-phalangeal joint area.

The objects and advantages of the invention are set forth in part herein and in part will be obvious herefrom, or may be learned by practice of the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

Figure 1:
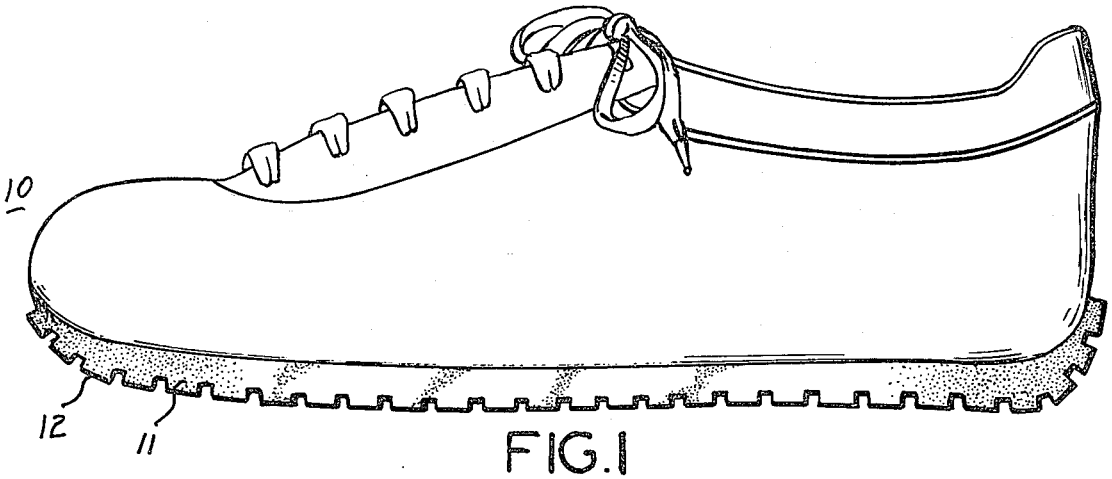
FIG. 1, is a side elevational view of an athletic shoe having a sole constructed in accordance with the invention.

Briefly described, the present invention relates generally to an improved design associated with the fabrication and construction of an athletic shoe sole capable of minimizing stress and strain to the functioning portions of the human body associated with any athletic endeavor that utilizes an individual's lower extremities to participate in same.

As herein preferably embodied, there is created at the metatarso-phalangeal joint area of the sole of said shoe a variation in the composition of said sole, such that the compression and expansion characteristics thereof are at variance with the compression and expansion characteristics of the material composition that comprises the remaining portions of said sole so as to provide a greater flexibility of movement of said sole at said metatarso-phalangeal joint area than would normally be the case if no such variation in composition occurred.

In consideration of the above, the human gait cycle is considered to consist of two phases, namely the swing phase and the stance phase, the swing phase comprising approximately 35% of the entire human gait cycle while the stance phase comprises approximately 65% of the entire human gait cycle. In the context of this invention, the stance phase of the entire human gait cycle is relevant since it is during this phase of the human gait cycle that this invention seeks to minimize muscle fatigue and thus reduce the possibility of injury to an individual participating in athletic endeavors.

It is acknowledged within medical literature that approximately the first 25% of the stance phase of the human gait cycle relates to having the human heel contact the surface upon which an individual is walking or running, the heel contacting said surface in an attitude of from 2° to 3° varus or inversion. At this point in time the knee is slightly flexed and the tibia is internally rotating to allow for foot pronation and impact shock absorption. The foot at this point is a mobile adaptor and is allowing itself to seek out the contour of surface in question. The triceps surae is the first muscle group to act on the foot during this contact phase, same plantar flexing the calcaneus or heel bone thus stabilizing the lateral side of the foot. Counterbalancing occurs on the frontal plane by the peroneus longus muscle stabilizing the first ray by virtue of its insertion into the lateral surface of the first cuneiform and first metatarsal base. During this portion of the stance phase the anterior muscle group of the leg is acting as a decelerator of the foot versus the surface in question.

Following heel contact there occurs the midstance portion of the stance phase of an individual's gait cycle, this phase of the gait cycle being the single limb support phase in normal walking or jogging and represents the middle 50% of the stance phase. The lower leg which was internally rotating at heel contact and the foot which was pronating now cease this direction and reverse themselves, i.e. the foot begins to supinate and the leg externally rotates. The foot is at this point changing its role of mobile adaptor to that of a rigid lever to prepare itself for a stable toe-off. This change in function to a rigid lever is vital to allow the leg muscles and tendons to function efficiently at push-off. During flat-foot and midstance portions of said stance phase, the triceps surae (gastroc nemius and soleus) is contracting to lift the heel. The metatarso-phalangeal articulations must flex 30° to achieve heel-off. This anterior break or hinge action continues to almost 90° at toe-off. The flexor muscles are contracting to hold the anterior foot against the ground and the peroneus longus has begun its active phase at flat-foot and continues through toe-off. The tibialis posticus is a strong invertor of the foot which helps lock the midtarsal joint and therefore cause the foot to become a rigid lever at the T.M.P. joint.

The last 25% of the gait cycle is the propulsive phase. The major thrust of the propulsion is transferred from the first metatarsal out along the great toe. The lever system of the foot is now peaking. The fulcrum of the lever is across the ball of the foot with the longer arm of the lever being represented by the distance from metatarsal phalangeal joints to the heel and the shorter arm from the metatarsal phalangeal joint anteriorly. This length ratio is 2:1 and therefore it takes two times the effort to lift the load (body weight). The muscles that are in phase at this point are the flexors of the foot to keep the toes pressed against the ground. The anterior tibial muscles are dorsiflexing the foot through swing phase. At toe-off the "rigid lever" foot is carried through swing phase dorsiflexed and being readied by directions of motion (internal tibial rotation and pronation) for heel contact and the mobile adaptor.

As is readily recognizable, by reducing the muscular effort needed to flex the sole of a shoe at the metatarso-phalangeal joints, there is achieved a reduction in muscular fatigue and possible injury incurred by individuals participating in athletic endeavors that utilize the lower extremities of a participant's body.

As hereinbefore set forth, by altering the composition of material utilized in constructing a sole at the metatarso-phalangeal joint area such that said sole has a greater degree of flexibility at said location one achieves the overall advantages associated with the present invention.

The accompanying drawings referred to herein and constituting a part hereof, are illustrative of the invention but not restrictive thereof, and, together with the description, serve to explain the principals of the invention.

DESCRIPTION OF PREFERRED EMBODIMENT

Referring now more particularly to the embodiment of the above invention illustrated in the accompanying drawings, there is illustrated in FIG. 1 an athletic shoe having a sole constructed in accordance with the invention, said shoe being indicated generally by reference numeral 10.

In accordance with the invention, athletic shoe 10 is constructed and fabricated aside from the design of its sole 11 in a method and manner well known in the prior art, being fashioned from an aesthetic standpoint in any number of patterns, any one of which being compatable with the invention as herein disclosed.

Figure 2:
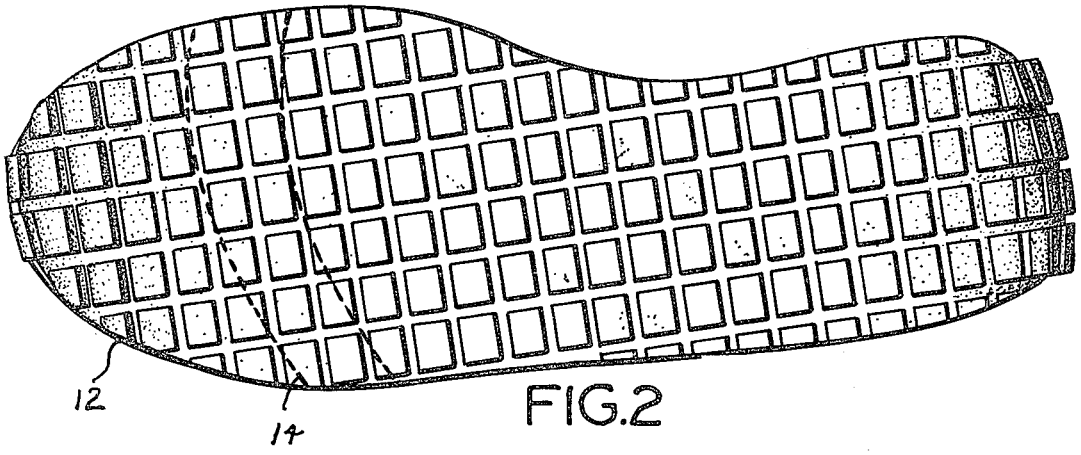
FIG. 2, is a bottom elevational view of an athletic shoe having a sole constructed in accordance with the invention.

As set forth in FIG. 2, there is depicted exterior surface 12 of sole 11, said exterior surface evidencing a cleat arrangement capable of providing traction to the wearer thereof on any number of variety of surfaces, the composition associated with the fabrication of exterior surface 12 comprising any one of a number of compositions of material well known in the prior art, be it a synthetic composition of any number of rubber based materials, plastic based materials, combinations thereof, animal hide, or the like.

Figure 3:
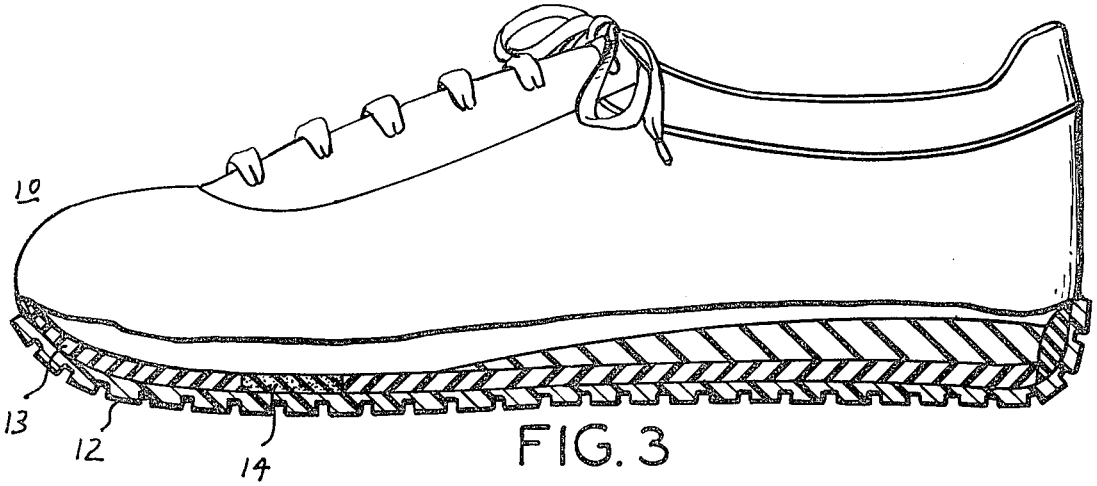
FIG. 3, is a partial cross-sectional view of the athletic shoe illustrated in FIG. 1 having a sole constructed in accordance with the invention, same illustrating the composition of said sole.

FIG. 3 is a partial cross-sectional view of athletic shoe 10 evidencing the construction of sole 11 in accordance with the invention. As depicted in FIG. 3, sole 11 comprises an exterior surface 12 evidencing a cleat arrangement capable of providing traction on any number of surfaces to the wearer thereof, said exterior surface 12 being, as previously stated, fabricated from any one of a number of materials well known in the prior art, be it rubber, various synthetic based rubber compositions, plastic based materials, combinations thereof, animal hide, or the like.

The inner layer 13 of sole 12 can be fabricated from any one of a number of materials well known in the prior art, be it rubber, various synthetic based rubber like compositions and the like, there occurring in the fabrication of inner layer 13, a variation in material utilized to fabricate said inner layer 13, said variation in material being evidenced by insert 14 that coincides as to location in inner layer 13, with the location where the wearer of athletic shoe 10 would have located his metatarso-phalangeal joints.

In keeping with the invention, insert 14 of inner layer 13 can be fabricated from expanded polyethylene form, some examples thereof being the trademarked materials known as Plastizote, Tenozote and Evazote. Additionally, it is within the scope of this invention to utilize a material known within the prior art as latex rubber butter or for that matter, any material that will provide a maximum of six pounds of pressure to cause flexion at the anterior break of said athletic shoe 10 which coincides with the wearer's metatarso-phalangeal joints. In this manner, and as depicted in FIG. 3, there is achieved the advantages and benefits of the invention.

Figure 4:
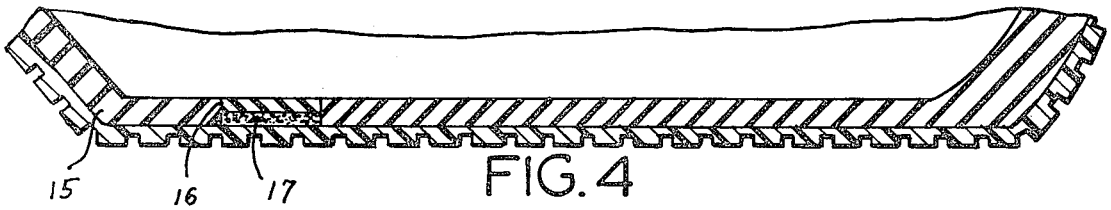
FIG. 4, is a partial cross-sectional view of an alternative embodiment of the sole of the athletic shoe illustrated in FIG. 1 having a sole constructed in accordance with the invention same illustrating said alternative composition of said sole.

In FIG. 4, there is illustrated an alternative embodiment of athletic shoe 10 wherein inner layer 15 has an insert whose composition comprises a combination of materials formed into a multilayer of composition, the upper layer 16 and the lower layer 17 consisting of any combination of materials such as plastizote, tenozote, evazote or other forms of expanded polyethylene, latex rubber butter, or any combination of materials that will result in a maximum of six pounds of pressure to cause flexion at the anterior break of said athletic shoe 10 which coincides with the wearer's metatarso-phalangeal joints.

The preceding description and accompanying drawings relate primarily to a specific embodiment of the invention, and the invention in its broader aspect should not be so limited to one specific embodiment as herein shown and described, but the departures may be made therefrom within the scope of the accompanying claims without departing from the principles of the invention and without sacrificing its chief advantages.

I claim:

1. An improved design for an athletic shoe sole comprising:

(a) an exterior surface fabricated so as to provide traction with an exterior surface upon which said sole has physical contact;

(b) an inner layer coincident with and physically attached to said exterior surface having an insert fabricated from a material whose characteristics of compression and expansion vary from that of said inner layer, said insert occurring within said inner layer so as to be coincident with metatarso-phalangeal joints of a wearer of an athletic shoe having said sole; and (c) said insert having characteristics of compression and expansion such that the maximum pressure required to cause flexion at the anterior break of said athletic shoe sole which coincides with the wearer's metatarso-phalangeal joints is six pounds of pressure.

2. An improved design for an athletic shoe sole as described in claim 1 wherein said insert is fabricated from an expanded polyethylene.

3. An improved design for an athletic shoe sole as described in claim 1 wherein said insert is fabricated from latex rubber butter.

4. An improved design for an athletic shoe sole as described in claim 1 wherein said insert comprises a combination of materials formed into a multilayer of composition.

* * * * *